United States Patent [19]

Dworsky

[11] Patent Number: 4,918,050

[45] Date of Patent: Apr. 17, 1990

[54] REDUCED SIZE SUPERCONDUCTING RESONATOR INCLUDING HIGH TEMPERATURE SUPERCONDUCTOR

[75] Inventor: Lawrence Dworsky, Northbrook, Ill.

[73] Assignee: Motorola, Inc., Schaumburg, Ill.

[21] Appl. No.: 177,296

[22] Filed: Apr. 4, 1988

[51] Int. Cl.[4] ..... H01P 1/203; H01P 7/08

[52] U.S. Cl. ..... 505/1; 505/701; 505/866; 333/995; 333/219; 333/204

[58] Field of Search ..... 333/219, 204, 995; 505/1, 866, 856, 700–704

[56] References Cited

U.S. PATENT DOCUMENTS

| | | | |
|---|---|---|---|
| 3,857,114 | 12/1974 | Minet et al. | 333/204 X |
| 4,523,162 | 6/1985 | Johnson | 333/202 |
| 4,609,892 | 9/1986 | Higgins, Jr. | 333/204 |
| 4,701,727 | 10/1987 | Wong | 333/204 |

OTHER PUBLICATIONS

Vendik, O. G. et al., "Superconducting-Film Stripline Filter"; *Soviet Tech. Phys. Letters*; vol. 7 (6); Jun. 1981; pp. 316, 317.

DiNardo, A. J. et al.; "Superconducting Microstrip Hi-Q Microwave Resonators"; *Journal of Applied Physics*; vol. 42, No. 1; Jan. 1971; pp. 186–189.

Kwon, O. K. et al.; "Superconductors as Very High Speed System Level Interconnects"; *IEEE Electron Devices Letter*; vol. EDL-8, No. 12; Dec. 1987; pp. 582–585.

Henkels, W. H. et al.; "Penetration Depth Measurements on Type II Superconducting Films"; *IEEE Transactions on Magnetics*; vol. MAG-13, No. 1; Jan. 1977; pp. 63–66.

O. K. Kwon, B. W. Langley, R. F. W. Pease, and M. R. Beasley, "Superconductors as Very High Speed System-Level Interconnects", Semiconductor Research Corporation, private communication, Sep. 15, 1987, 15 pages.

Lexis/Nexis, Darrel Whitten of Prudential-Bache Securities, "International Symposium on Superconducting Materials", Mar. 21, 1987, one page.

Lexis/Nexis bis Informat Newsfile, "Japan-Toshiba Announces First Superconductive Wire", International Herald Tribune, Apr. 3, 1987, p. 17.

N. H. Meyers, "Inductance in Thin-Film Superconducting Structures", Proceedings of the IRE, Nov. 1961, pp. 1640–1649.

T. B. Gheewala, "Desing of 2.5 um CIL Circuits", IBM J. Res. Develop., vol. 24, No. 2, Mar. 1980, pp. 132–133.

O. K. Kwon, S. Y. Chou, R. F. W. Pease, and B. A. Auld, "An Accurate Transmission Line Model of Superconducting Interconnects for Very High Speed System-Level Packaging", SRC #85-10-064, IEEE VISI 7 GAAS Packaging Workshop, Sep. 1987, pp. 34–35.

S. Sridhar, "Microwave Technology and Materials Report", Microwave Journal, Jun. 1987, pp. 117–123.

J. C. Swihart, "Field Solution for a Thin-Film Superconducting Strip Transmission Line", Journal of Applied Physics, vol. 32, #3, Mar. 1961, pp. 461–469.

*Primary Examiner*—Eugene R. Laroche
*Assistant Examiner*—Benny T. Lee
*Attorney, Agent, or Firm*—Joseph P. Krause; Steven G. Parmelee

[57] ABSTRACT

An arrangement for a superconducting resonator suitable for use in electronic filters is disclosed, in which a resonator exhibits an increased amount of internal inductance without a lengthening of the resonator. By utilizing a relatively thin dielectric material, a significant amount of magnetic field is made to exist in a layer of the superconductors nearest to the dielectric. This magnetic field induces a non-negligible internal inductance within the layer. The net result of having this extra inductance is that the wave velocity is no longer a constant, independent of dielectric thickness. Thus the resonator can be constructed to be significantly shorter than the conventional wave velocity equation would imply. Hence, the present invention provides a reduction in the length as well as in the cross-sectional area of a resonator, which means that one or more of such resonators may then be advantageously utilized to achieve significantly reduced filter size.

17 Claims, 2 Drawing Sheets

1/2
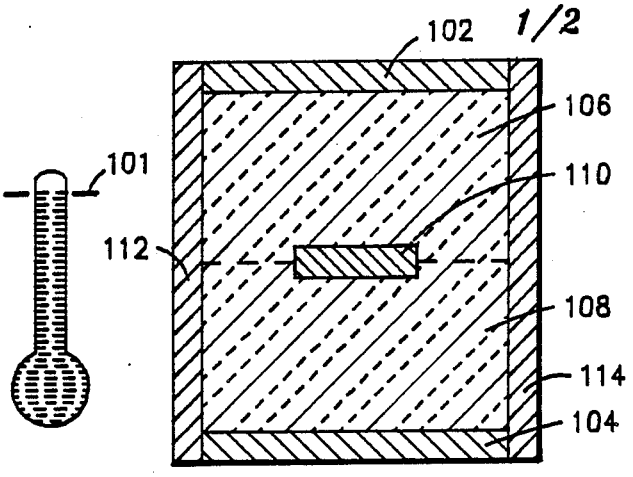
FIG. 1
—PRIOR ART—
FIG. 2B
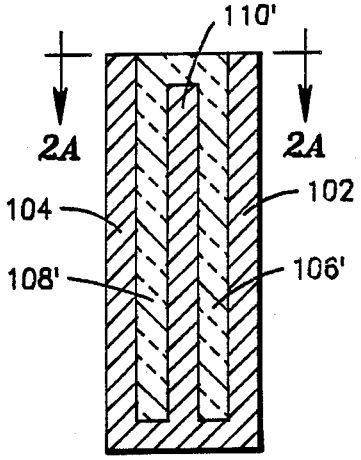
FIG. 2A
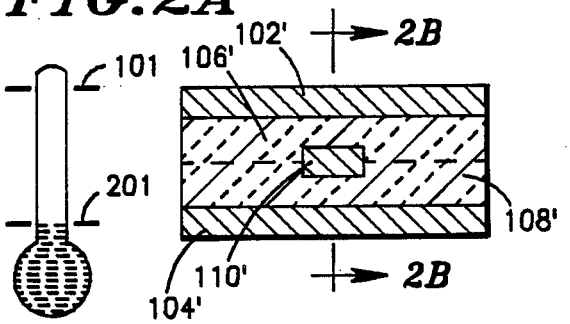
FIG. 3
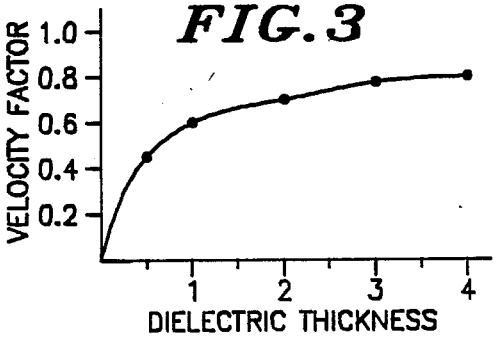
FIG. 4B
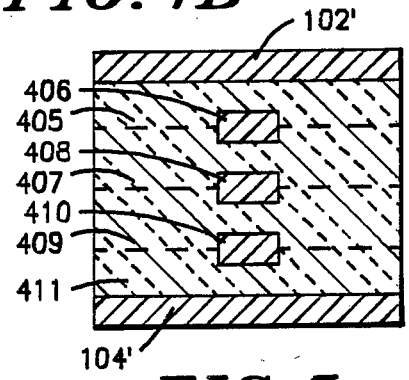
FIG. 4A
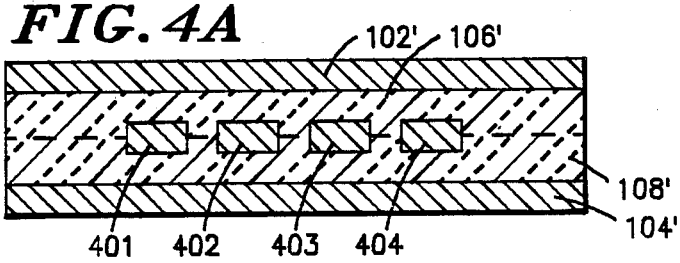
FIG. 5
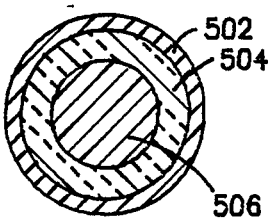

REDUCED SIZE SUPERCONDUCTING RESONATOR INCLUDING HIGH TEMPERATURE SUPERCONDUCTOR

BACKGROUND OF THE INVENTION

The present invention relates generally to electrical resonators. More particularly, this invention relates to filters that utilize a plurality of such resonators for radio applications where relatively small size is important.

There are many applications where it is necessary to provide a relatively small, low-loss filter for radio frequency signals. One such application is in modern communications systems, where it is desirable to provide a radio transceiver which packs higher performance and greater efficiency into a package having smaller size and lighter weight. One of the major limiting elements in the design of such radio transceivers is the use of one or more bandpass filters at the incoming and outgoing radio frequencies. Such bandpass filters are often realized using so-called Transverse Electromagnetic (TEM) mode filters. (As will be seen in a moment, the term "TEM mode" is merely a convenient approximation.)

Several arrangements for providing such filters are known. One such arrangement utilizes air as the dielectric for each of one or more resonators in the filter. Size constitutes a major disadvantage with such a filter. This disadvantage is further aggravated since such a filter must also be made with relatively heavy walls in order to adequately support the relatively large overall size of the structure.

A second known arrangement utilizes a solid ceramic dielectric having a relatively large dielectric constant. This second arrangement offers a size reduction for the filter by a factor corresponding to the square root of the relative dielectric constant of the ceramic material with respect to that of air. That is, by a factor roughly equal to the square root of the relative dielectric constant of the material.

In each of the above arrangements, the actual mode that exists is really a "quasi-TEM" mode. This mode is not a pure, true TEM mode because the skin-effect causes a longitudinal electric field to exist within the conductors that, in turn, causes a longitudinal electric field to exist in the dielectric. By the well-known boundary condition theorem, tangential electric fields across interfaces (i.e., between a conductor and the dielectric) must be continuous. Therefore, the lowest order transmission line mode that exists is the Transverse Magnetic (TM) mode, not the TEM mode.

In most conventionally constructed filters, this deviation from a true TEM mode is so small as to be ignorable, hence the term "quasi-TEM". This approximation also holds true for the two known arrangements given above, where they are constructed to have a dielectric separation thickness (whether air or solid ceramic) of at least 5 skin depths so that the majority of the magnetic fields lines are constrained to be within the dielectric, and minimally within the conductors. This constraint ensures that the small amount of magnetic field existing within the skin-layer of the electrical conductors is kept small as to be ignorable. In so doing, the relative wave velocity, also known as velocity factor, is a function dependent only upon the permittivity and the permeability of the dielectric medium.

Thus the prospect of further size reductions, having a factor comparable to the above, hinges on the availability of new materials being developed or discovered that have even higher dielectric constants, or permittivity constants greater than currently available.

Accordingly, there exists a need for another method of effecting further reductions in the size and weight of filters intended for use in radio applications, including mobile, and particularly portable, applications.

SUMMARY OF THE INVENTION

It is an object of the present invention to provide an electrical resonator that permits a significant size reduction while retaining relatively low loss for the resonator.

It is a further object of the present invention to provide an electrical resonator of the foregoing type in which the resonator utilizes superconducting elements to achieve further reductions in the overall size. The use of superconducting elements allows significant size (and weight) reductions, both in terms of the resonator axial length as well as in terms of the resonator cross-sectional area.

In practicing the present invention, one embodiment contemplates utilizing a resonator structure that exhibits an increased amount of low-loss inductance without a lengthening of the resonator. By utilizing superconductors separated by a relatively thin dielectric material, a significant amount of magnetic field is made to exist in a layer of the superconductors nearest to the dielectric. This magnetic field induces a non-negligible inductance within the layer. The net result of having this extra inductance is that the wave velocity is no longer a constant, independent of dielectric thickness. Thus the resonator can be constructed and arranged to be significantly shorter than the conventional wave velocity equation would imply.

Hence, the present invention provides a reduction in the length as well as in the cross-sectional area of a resonator, which means that one or more of such resonators may then be advantageously utilized to achieve significantly reduced filter size.

BRIEF DESCRIPTION OF THE DRAWINGS

FIG. 1 is a top, cross-sectional view of a resonator according to the known art that operates at normal ambient temperatures.

FIG. 2A is a top, cross-sectional view of a resonator, constructed and arranged according to the present invention, that operates at superconducting temperatures.

FIG. 2B is a side, cross-section view taken at line 2B given in FIG. 2A.

FIG. 3 is a graph of the functional dependence of relative wave velocity versus normalized penetration depth for the resonator of FIGS. 2A, 2B.

FIG. 4A is a top, cross-sectional view of a filter having a plurality of resonators given in FIGS. 2A, 2B.

FIG. 4B is a top, cross-sectional view of another filter having a plurality of resonators arranged in a different manner from that of FIG. 4A.

FIG. 5 is a top, cross-sectional view of an alternate embodiment of a superconducting resonator according to the present invention.

DETAILED DESCRIPTION OF THE PREFERRED EMBODIMENT

Figure 1A:
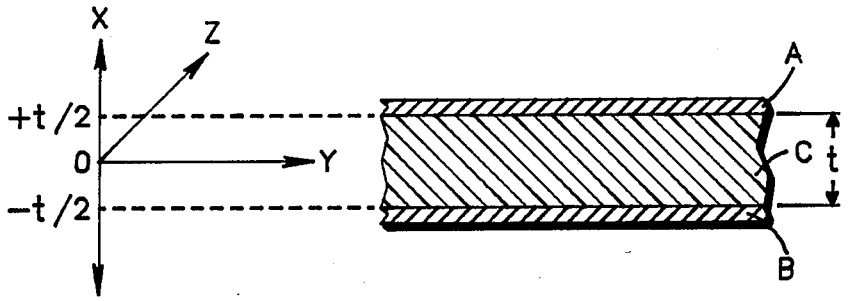
FIG. 1A is a side view of a resonator and a three dimensional coordinate axis system.

Referring to the drawings, a basic resonator according to the known art is shown in FIG. 1. This resonator operates at nominal ambient temperatures, typically a range (−30 to +70 degrees) roughly centered at 20 to 25 degrees Centigrade, as represented by the temperature level (101).

The resonator includes two conducting planes (102 and 104) separated by at least two dielectric layers (106 and 108), and at least one conductor (110) located between the two dielectric layers (106 and 108). As shown, each dielectric layer has a separation thickness equal to at least 5 skin depths in the conductors. The skin depth is defined as that distance below the surface of a conductor where the current density has diminished to 1/e of its value at the surface. See the *Reference Data For Radio Engineers,* Fifth Edition, 1972, pages 6–4 to 6–8.

The conducting planes (102 and 104) each have a thickness equal to at least 5 skin depths. The resonator may also have additional side conducting planes (112 and 114) to enhance quality factor (Q) and to shield external signals and noise from the resonator. Quality factor (Q) is defined as the energy stored in a circuit or device divided by the energy dissipated per cycle.

Next, FIGS. 2A, 2B show a superconducting resonator that operates at a temperature level (201). Note that although the temperature level (201) is below that of ambient temperature (101), it should preferably be as high as the superconducting material will permit. The resonator includes two outer superconducting planes (102' and 104') separated by at least two dielectric layers (106' and 108'). At least one superconductor (110') is located between the two dielectric layers. As shown, each dielectric layer (106' and 108') has a separation thickness equal to less than 5 penetration depths, where the penetration depth is defined as that depth where the field has decreased to (1/e) of its value at the surface as $$e^{-(a)},$$

where (a)=the normalized distance × into the superconductor surface relative to the electrical signal wavelength, (lambda).

Each of the superconducting planes (102' and 104') has a thickness which is at least 5 penetration depths. As a result, this resonator is relatively smaller in cross-sectional area than that shown in FIG. 1.

In order to understand the nature of the slow wave phenomenon, consider the device of FIG. 1A which shows a pair of conductors in which fringing fields can be ignored and work on a per-unit-width, per-unit-length basis. Such a structure would have two planar sheets (A and B) for the electrical conductors, which are separated by a dielectric (c) having thickness (t). A midpoint of the thickness is given a value (0) for the x-axis so that at the two interfaces of the dielectric with the conductors, (x) has values of (+t/2) and (−t/2), respectively. There are no variations in the (y) direction, and current flow is in the (z) direction.

From elementary analysis, the magnetic field is y-directed, and within the dielectric, is essentially constant. For convenience, (H), the magnetic field vector is set equal to 1 in the dielectric.

From Maxwell's equations, for a good conductor, a current density (J) in the conductors is induced by the magnetic field vector (H) as $$J=dH/dx \tag{1}$$

and, from London's superconductor equations for the idealized case where there are no normal electrons, $$H=e^{-x/\lambda}, \tag{2}$$

where λ is the penetration depth of the superconductor. Since (H) must be continuous across the dielectric-conductor boundary, equations (1) and (2) may be combined to give the current density (J) as $$J=\frac{-1}{\lambda}\,e^{-x/\lambda}. \tag{3}$$

The total current flowing in either conductor is, therefore, $$|I| = \int_{t/2}^{\infty} J dx = e^{-(t/2\lambda)}, \tag{4}$$

which is essentially=1 for $t << \lambda$.

The total stored (magnetic field) energy in the dielectric is, therefore, given as $$\int_{-t/2}^{t/2} (\tfrac{1}{2})\mu H^2 dx = \mu t/2, \tag{5}$$

and since $$(\tfrac{1}{2})LI^2=\int(\tfrac{1}{2})\mu H^2 dx, \tag{6}$$

the total inductance due to (magnetic) energy storage in the dielectric is $$L_{ext}=\mu t \tag{7}$$

In the superconductors, the stored magnetic energy is $$(2)(\mu/2)\int_{t/2}^{\infty} e^{-(2x/\lambda)}dx = \mu\lambda/2, \tag{8}$$

and the inductance due to this energy is $$L=\mu\lambda \tag{9}$$

The capacitance of the structure is simply the parallel plate capacitance, $$C=\epsilon/t, \tag{10}$$

and the propagating wave velocity is therefore $$\frac{1}{\sqrt{LC}} = \frac{v_d}{\sqrt{1+\lambda/t}},$$

where $$v_d = \frac{1}{\sqrt{\epsilon\mu}},$$

the usual TEM wave velocity.

From the above relations it is clear that the fields in the superconductors fall off from their values at the surface that interfaces with the dielectric so that the penetration depth in the superconductors has effectively replaced the skin effect parameter as seen in normal conductors.

Equation (11) represents an approximation in that it omits the kinetic energy contribution of the (super)electrons. This contribution would introduce a small correction factor that would not change the functional form or the limiting cases if carried through the above analysis.

Although an approximation, equation (11) shows reasonably well that (v) goes to (O) as (t) goes to (O), and that (v) goes to the usual TEM wave velocity when (t) gets large, relative to the penetration depth. This can be seen best in FIG. 3, which shows a plot of the relationship between relative wave velocity, or velocity factor, along the vertical axis, versus dielectric thickness (as normalized to the penetration depth) along the horizontal axis. This graph clearly shows, for example, that a 40% resonator size (or heigth) reduction can be achieved by utilizing a dielectric thickness that is approximately equal to one penetration depth in the superconductors. Thus, for a material having a penetration depth of approximately 1000 Angstroms, or $1*10^{-7}$ meters, the relation given above is reasonable (for the parameters chosen) for $(t)<1000$ Angstroms. As a result, various filter configurations utilizing reduced size and heighth resonators are possible.

FIGS. 4A and 4B show two of such possibilities. That is, FIG. 4A shows a filter having two outer, superconducting planes (102', 104'), having at least two layers of dielectric (106' and 108') with adjacent resonators (401, 402, 403, 404) arranged side-by-side to provide electrical coupling therebetween. This filter can be arranged in a comb-line configuration in which all resonators have a short-circuited end at the bottom of the structure.

Likewise, FIG. 4B shows a filter structure in which at least two outer, superconducting planes (102' and 104') are arranged to house alternating layers of dielectric (405, 407, 409, 411) and superconductors, (406, 408, 410) in a sandwich, as shown.

Alternatively, each of the above filters can have resonators arranged in an interdigital configuration in which every other resonator has a short-circuited end at the bottom of the structure.

Finally, FIG. 5 depicts another resonator structure suitable for practicing the present invention. It includes an outer superconductor (502), which surrounds included dielectric material (504) that surrounds an included superconductor (506). The dielectric material (504) is designed with a separation thickness of less than 5 penetration depths in the superconductors and with the superconductors substantially parallel to each other. As a result, this resonator exhibits in similar fashion the significantly slower wave velocity that enables the heighth to be smaller than conventional resonators.

Thus, in each of the above embodiments, resonator structure not only reduces the cross-sectional area of a given single resonator or filter, but also causes a significant amount of the magnetic field to exist in a layer of the superconductors nearest to the dielectric so that it exhibits an internal inductance which is a significant part of the total inductance. The net result of having this extra inductance is that the wave velocity is no longer a constant, independent of the dielectric thickness, but approaches a (1/t) dependence. Thus this phenomenon allows the resonator to be significantly shorter than resonators built in accordance with the conventional wave velocity equation.

Various materials can be utilized for the dielectric material, including ceramic compounds and various plastic film materials, such as polytetrafluoroethylene and polyimide films.

For the superconductors, various materials are already known to exhibit superconducting properties, although at very low temperatures that presently limit their economical use. These materials include metals such as tin, lead, niobium, which are superconductive near 7 degrees Kelvin, and other compounds listed in any *Handbook of Chemistry and Physics,* published at frequent intervals by the Chemical Rubber Company. (For example, the 47th Edition, 1966, pages E-71 to E-86). While not exhaustive, this list shows that many materials and compounds are already known. Several new compounds, such as ytrium barium copper oxide compounds, have been discovered which are superconductive near 77 degrees Kelvin, the temperature of liquid nitrogen. The discovery of these compounds, coupled with current materials research efforts to develop new materials, implies that the upper temperature limit of the superconducting phenomena will be raised.

As a result, each of the above arrangements is able to overcome the limitations of the known art.

I claim:

1. A resonator offering significantly smaller size in terms of length as well as in cross-sectional area for a given electrical signal, the resonator comprising:

a first superconducting means, for conducting an electrical signal thereon;

a second superconducting means for conducting an electrical signal thereon; and, a first dielectric insulating means for electrically insulating said first superconducting means from said second superconducting means, said first dielectric having first and second surfaces, said first and second superconducting means respectively coupled to said first and second surfaces, said first dielect defining between said first and second surfaces a thickness which is less than or equal to five penetration depths of a signal carried in said superconductors, said first and second superconducting means each exhibiting a substantial amount of internal inductance with low loss such that an electrical signal propagated in said resonator has a velocity inversely proportional to the thickness of said dielectric.

2. The resonator according to claim 1, wherein said second superconducting means includes at least one end directed coupled to said first superconducting means.

3. The resonator according to claim 1, wherein said second superconducting means includes a ceramic compound superconductor.

4. The resonator according to claim 1, wherein said dielectric insulating means includes a ceramic material having a dielectric constant greater than that of free space.

5. The resonator according to claim 1, wherein said dielectric insulating means includes a material having an essentially circular, cylindrical shape.

6. The resonator according to claim 1, wherein said dielectric insulating means comprises:

(a) a first planar sheet of dielectric material; and (b) a second planar sheet of dielectric material constructed and arranged parallel to said first planar sheet.

7. The resonator according to claim 1, wherein said first superconducting means includes a material having superconducting properties at a temperature well above 7 degrees Kelvin.

8. The resonator according to claim 1, wherein said first superconducting means includes a material having superconducting properties at a temperature well above 77 degrees Kelvin.

9. The resonator according to claim 1, wherein said first superconducting means includes a metallic superconductor.

10. The resonator according to claim 1, wherein said first superconducting means includes a ceramic compound superconductor.

11. The resonator according to claim 1, wherein said second superconducting means includes a material having superconducting properties at a temperature well above 7 degrees Kelvin.

12. The resonator according to claim 1, wherein said second superconducting means includes a metallic superconductor.

13. A filter having a plurality of superconducting resonators, the filter comprising:

(a) at least two electrically superconducting planes separated by at least two layers of an included dielectric material, said layers of included dielectric material having a thickness less than or equal to five penetration depths of a signal carried in said superconducting planes; and (b) at least two electrical superconductors, arranged adjacent to each other at a predetermined distance and disposed between said at least two layers of dielectric material, said dielectric material causing said electrical signal to induce a significant amount of electromagnetic energy in said superconductor and in said at least two electrically superconducting planes, and said at least two superconductors and said at least two superconducting planes exhibiting an increased amount of internal inductance with low loss that permits a significant shortening of the resonators within said filter.

14. A resonator having significantly smaller size for a given electrical signal, the resonator comprising:

(a) at least two, electrically superconducting planes separated by at least two layers of dielectric material, each of said dielectric layers having a respective separation thickness less than or equal to five penetration depths of a signal carried in said superconducting planes; and (b) at least one electrical superconductor disposed between said at least two layers of dielectric material, said dielectric material causing said electrical signal to induce a significant amount of associated electromagnetic energy in said superconductor and in said at least two, electrically superconducting planes, and said superconducting and said at least two superconducting planes exhibiting an increased amount of internal inductance with low loss that permits a significant shortening of the resonator.

15. The resonator according to claim 14, wherein said at least one electrical superconductor comprises a material having superconducting properties at a temperature well above 7 degrees Kelvin.

16. The resonator according to claim 14, wherein said at least two, electrically superconducting planes comprise a material having superconducting properties at a temperature well above 7 degrees Kelvin.

17. The resonator according to claim 14, wherein said dielectric material includes a ceramic material having a dielectric constant greater than that of free space.

* * * * *